US005349912A

United States Patent [19]

Olewicz et al.

[11] Patent Number: 5,349,912

[45] Date of Patent: Sep. 27, 1994

[54] POCKET SETTER FOR FLAT AND TABULAR GARMENTS

[75] Inventors: Tadeusz A. Olewicz, Clinton; Ernst Schramayr, Barneveld, both of N.Y.

[73] Assignee: Jet Sew Technologies Inc., Barnefeld, N.Y.

[21] Appl. No.: 37,085

[22] Filed: Mar. 25, 1993

[51] Int. Cl.[5] ..... D05B 21/00

[52] U.S. Cl. ..... 112/262.2; 112/121.12

[58] Field of Search ..... 112/121.12, 121.15, 112/103, 262.1, 262.2, 265.1

[56] References Cited

U.S. PATENT DOCUMENTS

| | | | |
|---|---|---|---|
| 4,532,875 | 8/1985 | Gazzarrini | 112/262.2 |
| 4,685,407 | 8/1987 | Jünemann | 112/262.2 |
| 4,809,627 | 3/1989 | Upmeier et al. | 112/121.12 |
| 5,255,621 | 10/1993 | Schramayr et al. | 112/121.12 |

FOREIGN PATENT DOCUMENTS

| | | | |
|---|---|---|---|
| 0094662 | 5/1984 | Japan | 112/262.2 |
| 0119201 | 6/1985 | Japan | 112/262.2 |

*Primary Examiner*—Clifford D. Crowder
*Assistant Examiner*—Ismael Izaguirre
*Attorney, Agent, or Firm*—Schweitzer Cornman & Gross

[57] ABSTRACT

An apparatus for affixing garment parts, such as pockets to a tubular knit garment body (for example, a T-shirt) which permits conversion of conventional pocket setting equipment, the apparatus providing means to convert the tubular body essentially into a flat undistorted .garment surface prior to and during the stitching operation; followed by subsequent restoration of the tubular garment body prior to stacking.

8 Claims, 11 Drawing Sheets

POCKET SETTER FOR FLAT AND TABULAR GARMENTS

BACKGROUND OF THE INVENTION

There are currently a number of pocket setters available which are designed to pre-fold and sew pockets onto essentially flat, single ply garment parts. These machines are used primarily by the shirt, jean and uniform portions of the apparel industry and to some extent by makers of T-shirts. However, since the bodies of T-shirts are made of tubes that are knitted to size, the utilization of pocket setting equipment designed for single-ply garments on or in connection with tubular knit bodies, prior to the present invention, has been extremely difficult, or impossible, without stretching and distortion of the area of the garment body to which a pocket is stitched. Subsequent relaxation of the distorted area after pocket setting results in disparity (puckering) between the garment body and the pocket resulting in unacceptable quality and a high rate of rejection. In fact, it has only been possible to set pockets (although poorly) onto men's size T-shirt bodies (but not youth's or children's sizes) because only the largest sizes may be stretched and distorted sufficiently.

The apparatus of the present invention solves this problem in a unique manner, permits the utilization of standard flat garment pocket setting equipment on tubular knit bodies or alternatively the use of such apparatus on flat garment parts, knitted or woven.

SUMMARY OF THE INVENTION

According to the method and apparatus of the present invention, in utilizing the equipment disclosed herein for setting pockets on tubular knit garment bodies, the tubular knit body is initially drawn over a table section having a width less than the width of the knit body with the neck portion thereof inwardly located, the front arranged upon the top surface of the table and the back of the knit body beneath the table section. The tail portion of the garment body extends beyond the edge of the table section and shall be draped over a rail which extends separately from and parallel to the edge of the table. The front part of the knit body is essentially undistorted by this process and is positioned to receive a prefolded pocket in a prescribed location thereupon from an adjacent folding mechanism. After placing the pocket, a conventional fiat garment stitching clamp is brought down thereupon which clamps the pocket and the underlying pocket affixing area of the body against the surface of the table, while permitting subsequent sliding movement with respect to the table toward and beneath a sewing head. The stitching clamp is connected to a traveling clamp having a flat depending foot which presses the tail of the garment body against the rail in sliding engagement therewith. Before sliding the assembled garment body and pocket clamped thereon, slide members, one at each side of the table section, push the sides of the garment body over the edges of the table section toward the edge of the table section until the back of the garment body has cleared the edge of the table. This effectively converts the top (front) of the garment body into a single ply garment part for stitching of the pocket using standard pocket setting equipment, and also frees the garment body for transverse sliding movement of the front from the table section (loading station) to the sewing head or stitching station.

After the pocket has been set, the stitching clamp and traveling clamp are disengaged, spreader arms extend to flatten the gathered back potion of the body and a pulling mechanism removes the garment from the table. Stacker flip and clamp tubes cooperatively operate in conjunction with a sweep bar to throw the garment over a material rest plate, with successive ones thereafter creating a stack thereupon.

BRIEF DESCRIPTION OF THE DRAWING

FIG. 5 further illustrates the movement of slide members to gather the back of the tubular garment body while pushing the back of the garment body free of the table edge;

DESCRIPTION OF A PARTICULAR EMBODIMENT

Figure 1:
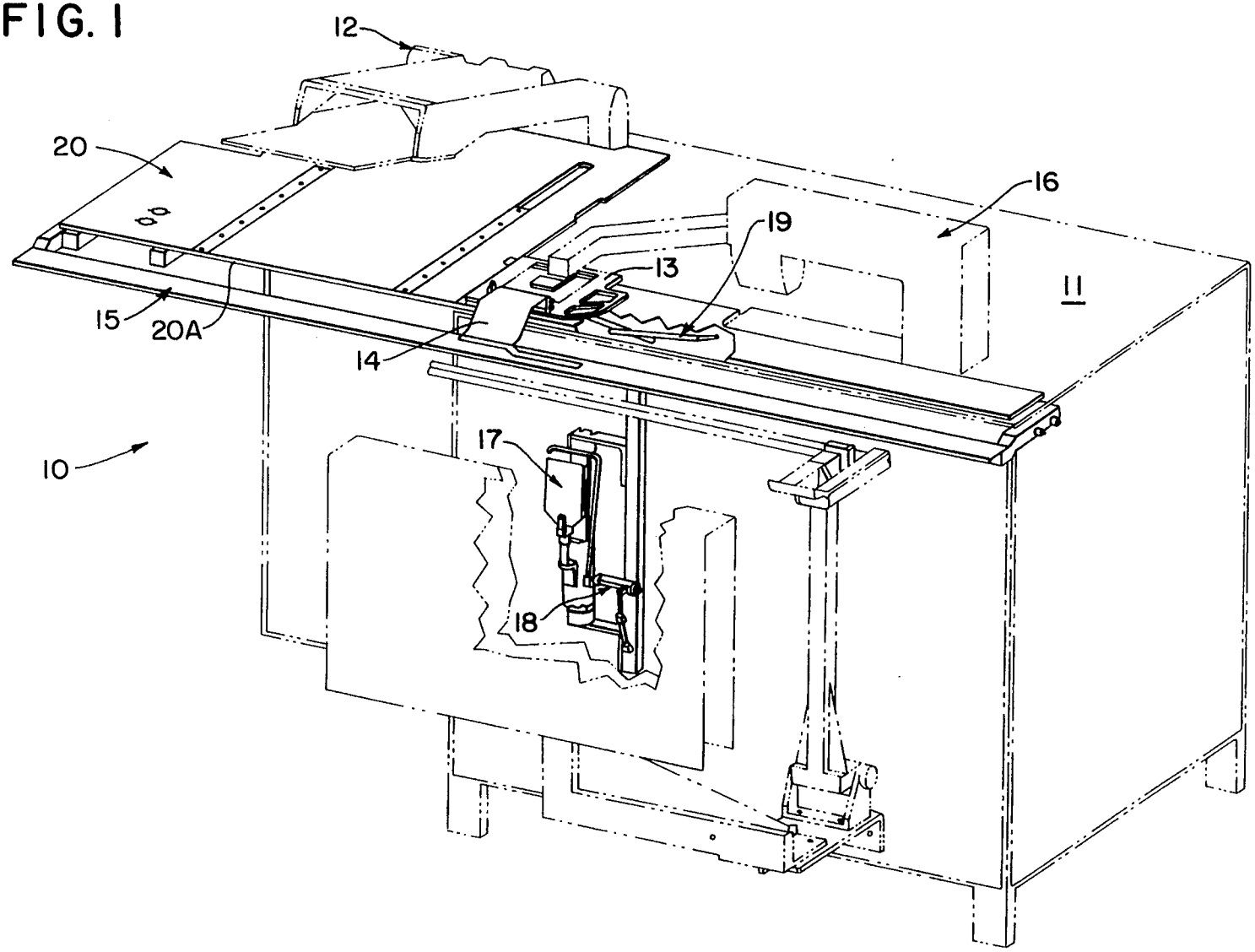
FIG. 1 illustrates an overall collective view of the apparatus of the present invention.

Referring now to the drawing and initially to FIG. 1 thereof a pocket setting machine 10 incorporating the features of the present invention has been illustrated. The machine 10 generally includes the following sections: table mechanism 11; pocket folding mechanism 12; stitching clamp 13; transfer clamp 14; transfer rail 15; sewing head 16; puller mechanism 17; sweep mechanism 18; and spreader mechanism 19. These shall now be described and correlated.

Figure 2:
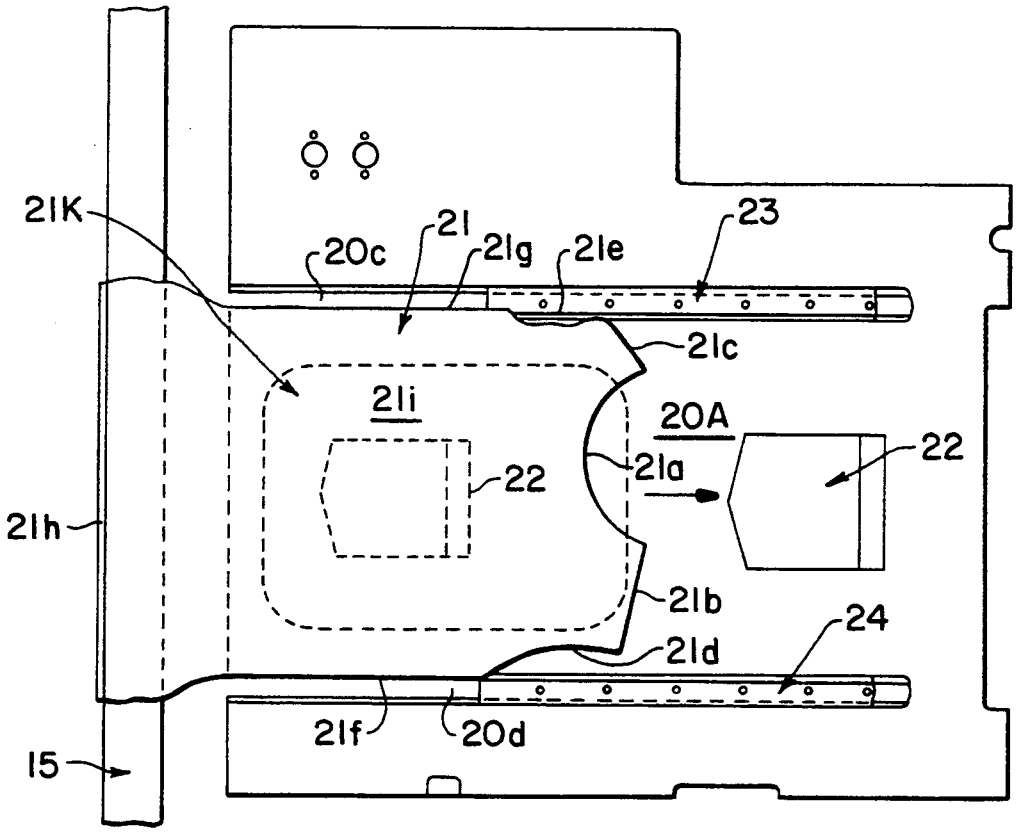
FIGS. 2 and 3 illustrate a table section adapted to receive a tubular knit garment body and the initial relative location of such body thereupon and thereunder.
Figure 3:
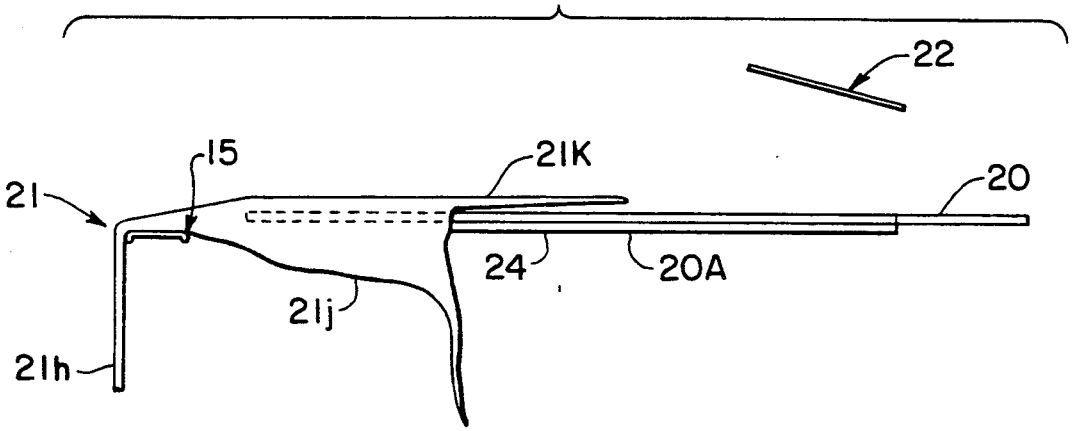

Referring to FIGS. 2 and 3, it will be seen that the table mechanism 11 includes a flat garment receiving section 20 having a loading station comprising a cut out section 20A over which a tubular knit shirt body 21 may be pulled inwardly to initiate the pocket setting sequence. The lateral dimension of section 20A shall be somewhat narrower than the width of any shirt body 21 drawn thereupon to avoid stretching of the shirt body and shall accommodate a broad range of widths of various shirt bodies on which pockets are to be set. In the embodiment, each shirt body has a neck area 21*a*, shoulders 21*b*, 21*c*, arm openings 21*d*, 21*e*, sides 21*f*, 21*g* and a tail section 21*h*. Body 21 further includes a top or front section 21*i* to which a pocket 22 shall be set (stitched) and a back section 21*j* which lies beneath table 20 after the shirt body 21 has been pulled over table 20. FIG. 2 further illustrates in outline the intended location of pocket 22 upon the shirt body 21 and also indicates an area thereof 21*k* which shall be maintained distortion free during the pocket setting operation.

Table 20 has been equipped with slide members 23, 24 which may be reciprocated in slots 20*c*, 20*d* which define section 20A. FIGS. 2 and 3 show slides 23, 24 in their retracted position in which little or no contact occurs between the ends of slides 23, 24 and 21*f*, 21*g* of shirt body 21, thereby permitting area 21*k* to be undistorted during initial drawing of shirt body 21 over table section 20A.

Figure 4:
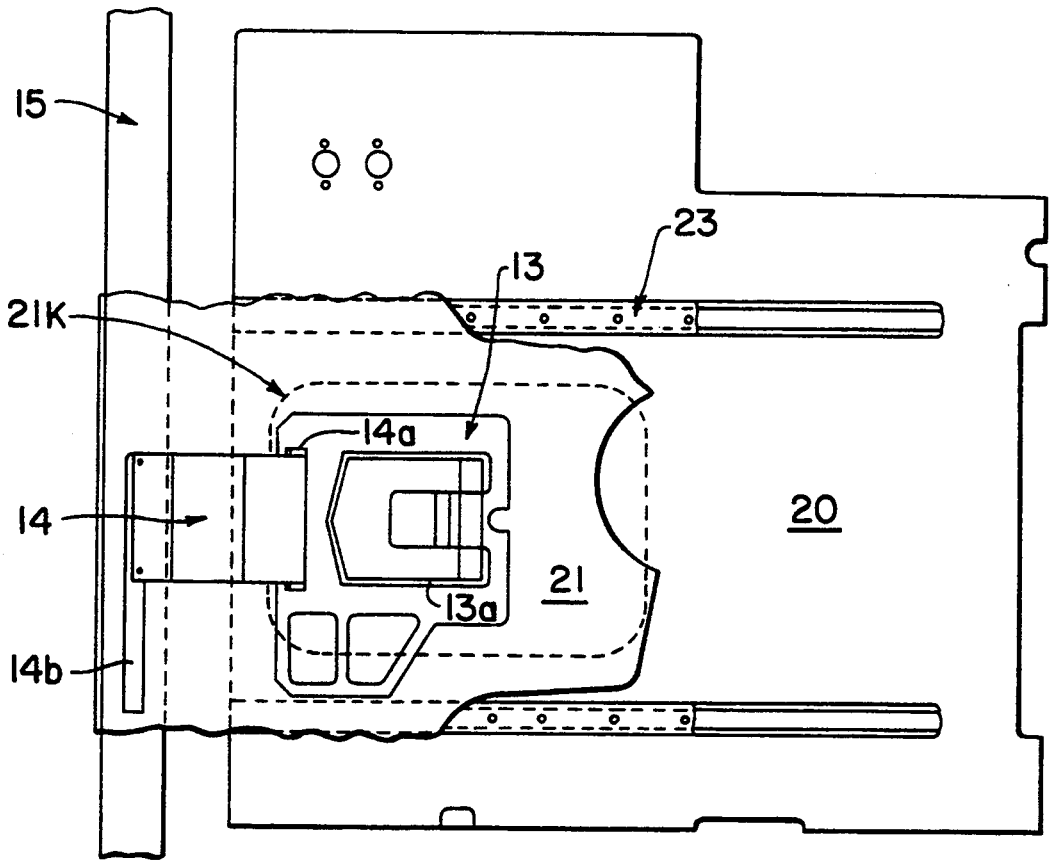
FIGS. 4 and 5 illustrate the positioning of a pocket upon the shirt front arranged upon the table section and the application of a stitching clamp against the pocket and shirt front and also a traveling clamp which passes against the tail portion of the garment body.
Figure 6:
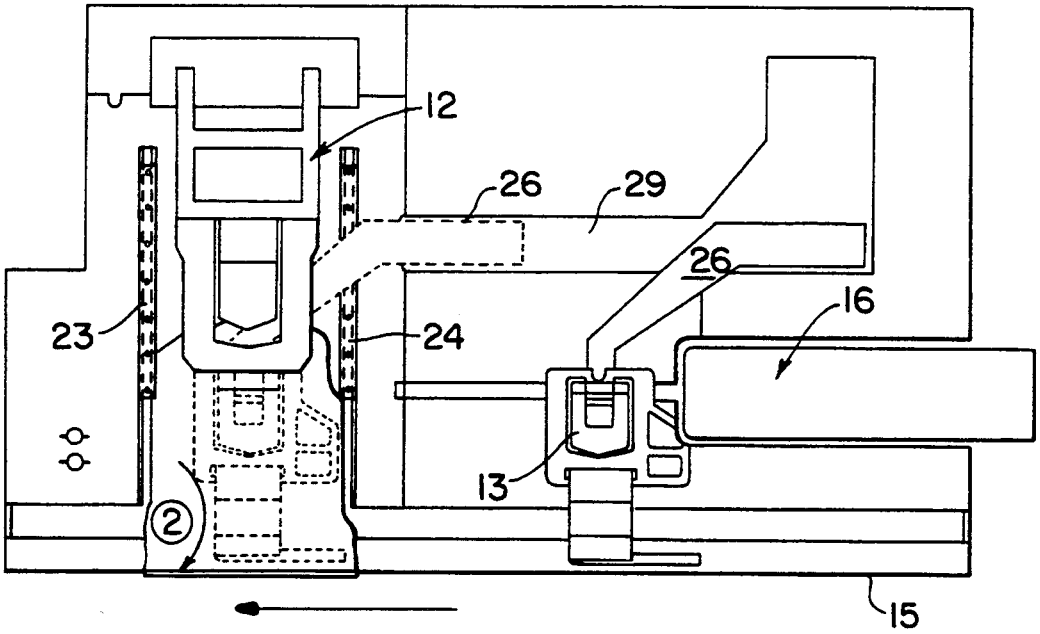
FIGS. 6 and 7 illustrate the movement of the garment body from the loading station to the stitching station.

Referring to FIG. 1 a pocket folding mechanism 12 has been illustrated diagrammatically which overlies table 20 and section 21K of shirt body 21 upon which the pocket 22 shall be set. Pocket folding mechanism 12 is of a type which is commonly used for pocket setting and need not be described herein in detail. It shall be sufficient to say that the pocket folding mechanism when loaded with an unfolded pocket shall operate to fold the perimetrical portion thereof in a prescribed manner about a blade which then deposits the folded pocket on the shirt front section 21*k* in a precise manner. FIG. 4 further illustrates stitching clamp 13 whose function is to hold or clamp a folded pocket 22 after the pocket has been received from and deposited by the folding mechanism 12 in an accurate and prescribed manner upon the shirt front. Stitching clamp 13 defines a groove 13*a* through which the periphery of pocket 22 may be stitched to the shirt front while clamp 13 presses and maintains pocket 22 and the shirt area against table 20. The present invention further provides attached to stitching clamp 13, a transfer clamp 14 which is rotatably connected to the stitching clamp 13 at 14*a* such that the depending end 14*b* thereof may be brought into contact with the tail portion of shirt body 21 to press tail portion against transfer rail 15 while the shirt body is being laterally moved to the stitching station. FIG. 6 illustrates sewing head 16 and power arm 26 attached to stitching clamp 13 to effect movement of stitching clamp 13 and transfer clamp 14 and sliding movement of the shirt body 21 between the loading position of FIG. 2 and the sewing position.

Figure 5:
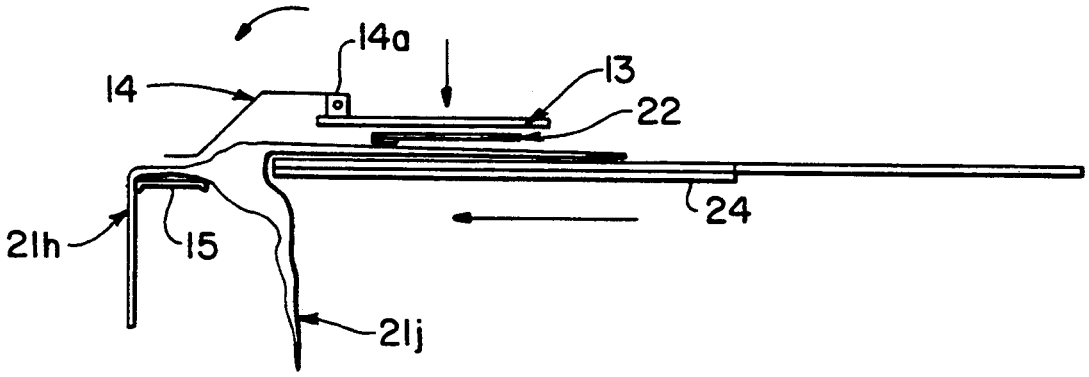

In order to effectuate such transfer, FIGS. 4 and 5 illustrate that after initial loading of the shirt body 21 onto table 20, slides 23, 24 shall be moved toward transfer rail 15 to cause the underside of the shirt body to be gathered and moved from beneath table 20. It is a feature of this invention that tubular shirt fabric shall readily permit such distortion and movement while the clamping of stitching clamp 13 of the pocket 22 against the shirt front maintains the distortion free area. By such action, the shirt body is freed from the loading section 20A of table 20 for lateral sliding transfer to sewing head 16 while maintaining the distortion free area and pocket 22 under the control of stitching clamp 13.

Figure 7:
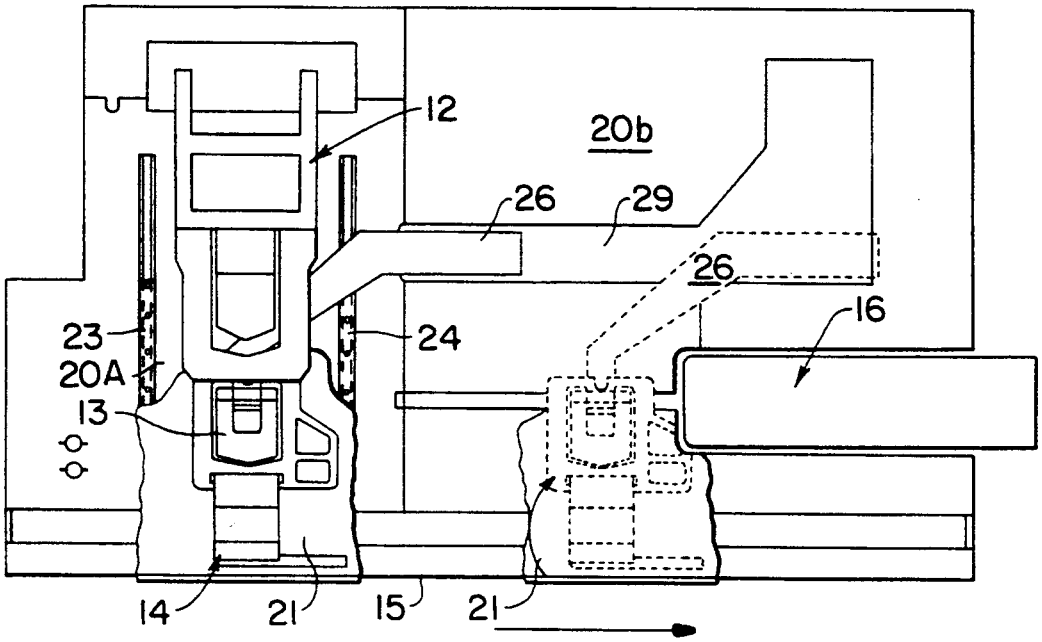

FIGS. 6 and 7 show the movement of the shirt body 21 with pocket 22 clamped thereon laterally across table 20 from the initial loading station 20A to the stitching station 20B. Arm 26 is attached at its distal end for this purpose to stitching clamp 13. The proximate end of arm 26 is activated by a pneumatic piston (not shown) which moves within chapel 29 between position 20A (shirt body loading) and position 20B (stitching). The entire assembly comprising the shirt body 21, stitching clamp 13 and transfer clamp 14 is moved across table 20 from the loading position 20A to the stitching station 20B while maintaining the area of the shirt front 21K under and immediately surrounding pocket 22 in an undistorted condition.

Figure 8:
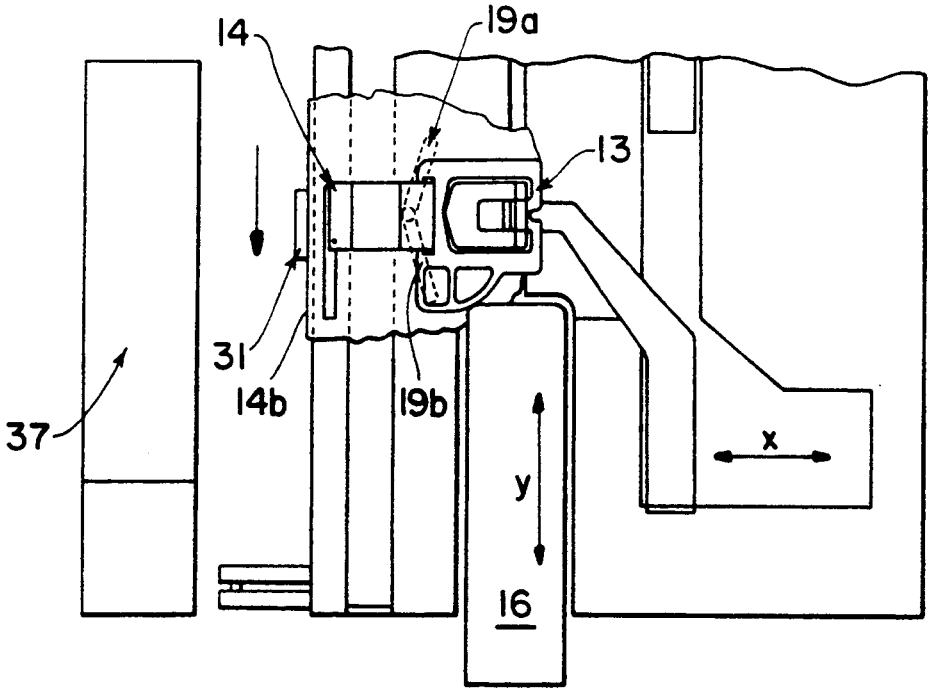
FIGS. 8 and 9 illustrate the location of spreaders to straighten the back of the garment body, initial retraction of the traveling clamp, initial engagement of a puller which engages the tail portion of the garment body and the initial positions of a stacker flip tube, stacker clamp tube and sweep bar with respect to the material rest member.
Figure 9:
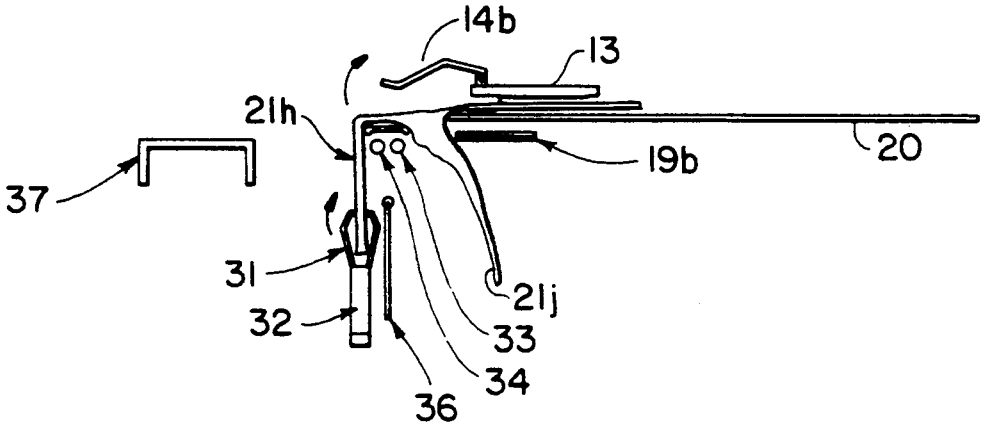
Figure 10:
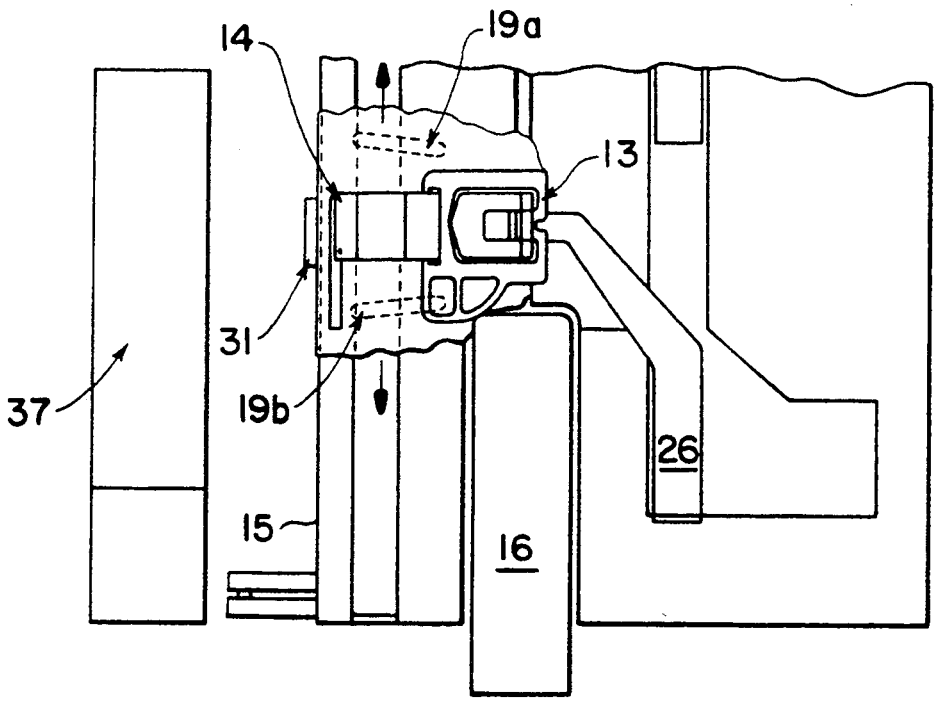
FIGS. 10 and 11 illustrate the extension and operation of the spreader mechanism to straighten the back portion of the garment body preparatory to stacking.
Figure 11:
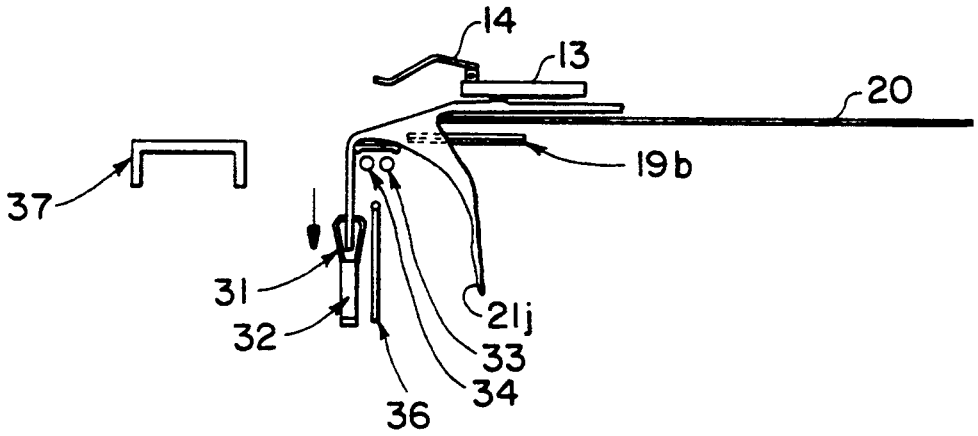
Figure 18:
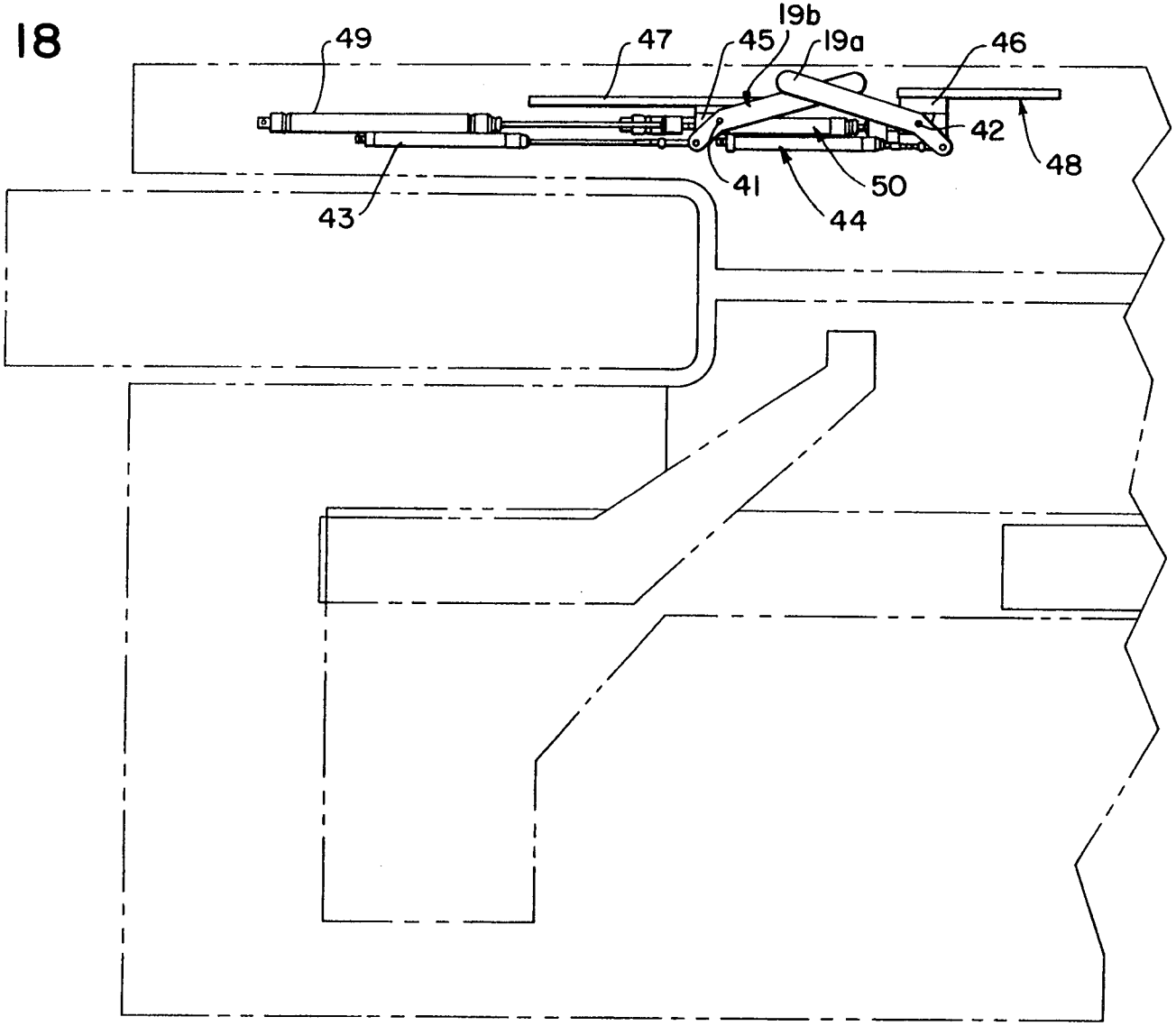
FIGS. 18 and 19 illustrate the actuating mechanism for retracting and extending the spreaders.
Figure 19:
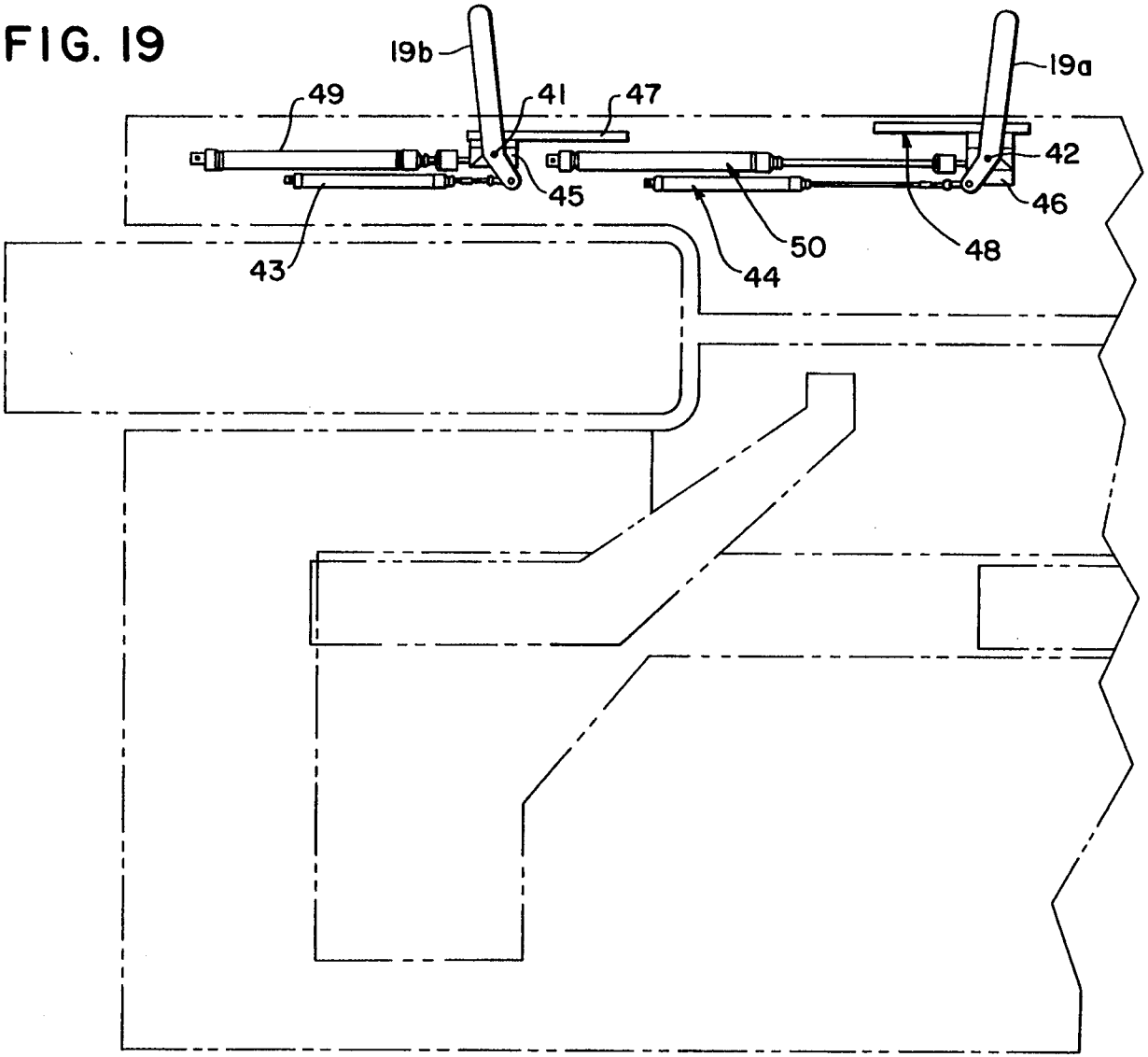

Referring to FIGS. 8–17 the handling and stacking of a shirt body 21 following setting of a pocket 22 has been illustrated. FIGS. 8 and 9 illustrate in particular a spreader mechanism 19 consisting of twin blades 19*a*, 19*b* which are situated beneath table 20. In FIG. 8 blades 19*a* and 19*b* are in a retracted position. As shown in FIGS. 10 and 11, blades 19*a* and 19*b* have been moved into an operative or extended position by an actuating assembly consisting of pneumatic tube actuators and articulating linkages (FIGS. 18 and 19) generally referred to by reference numeral 40. FIGS. 18 and 19 show in detail the actuating mechanism for blades 19*a* and 19*b*. Each blade has a primary pivot point 41, 42 about which rotation of the blade may be effected by respective pneumatic actuators 43, 44, 49, 50 to cause movement of each blade from the retracted positions of FIG. 18 to the extended positions of FIG. 19. Also, blades 19*a* and 19*b* are mounted upon respective brackets 45, 46 which are slidable away from or towards each other in channels 47, 48 by actuators 49, 50. FIG. 18 therefore illustrates the position of blades 19*a*, 19*b* when fully retracted; that is, each blade has been rotated across the other and has been brought by actuators 49, 50 compactly toward each other, while FIG. 19 illustrates full rotation of blades 19*a*, 19*b* away from each other and full movement of blades 19*a*, 19*b* transversely away from each other. As seen in FIGS. 10 and 11 spreader blades 19*a*, 19*b* when extended operate to move the sides 21*f*, 21*g* of the tubular shirt body laterally outwardly, which is done as a material handling step preparatory to stacking. It will also be seen beginning in FIGS. 8 and 9 that the jaws of a gripper 31 connected to puller 32 engage the tail section 21*h* preparatory to removing the shirt body from beneath stitching clamp 13 and transfer clamp 14, whose depending end 14*b* has been raised from engagement with tail section 21*h*.

FIGS. 8 and 9 further illustrate the positions of stacker flip tube 33 and stacker clamp tube 34. Therebeneath and parallel to the gripper 31 and puller is a sweep bar 36. The coordinated function of these elements of the apparatus is first to pull the shirt body from under the stitching clamp (after being released therefrom) and then to flip the shirt body over the material rest bar 37 to initiate the formation of a stack thereon of successive ones of such shirt bodies after each pocket setting operation has been completed.

Figure 12:
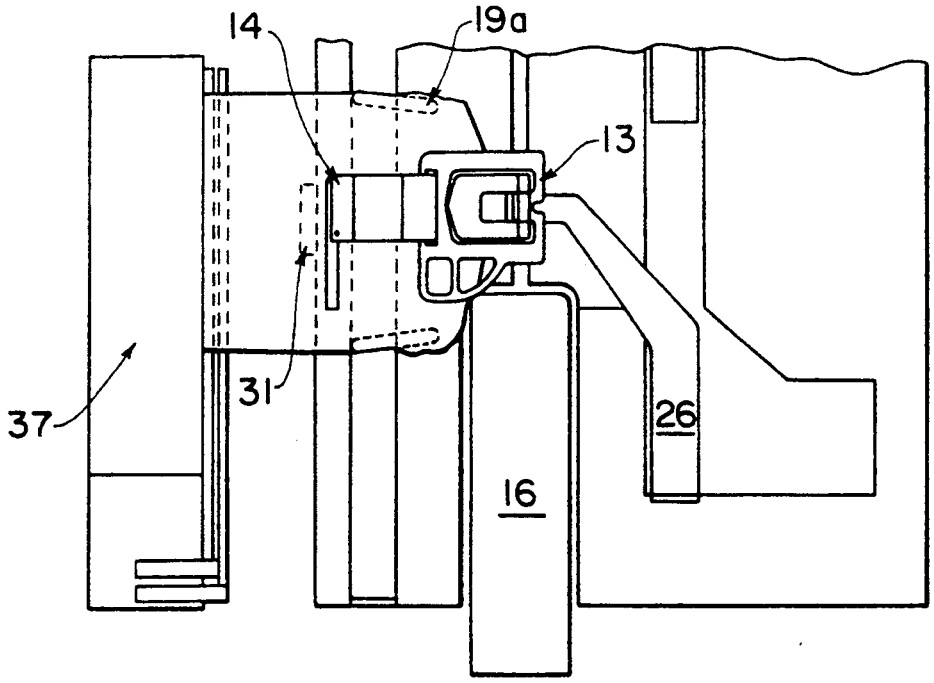
FIGS. 12 and 13 illustrate removal of the stitching clamp and movement of the stacker flip tube and clamp tube to withdraw the garment body from the table.
Figure 13:
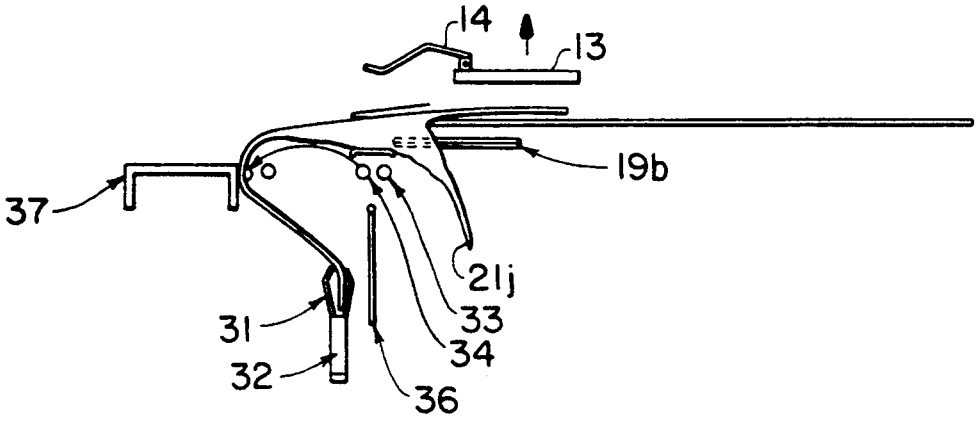
Figure 14:
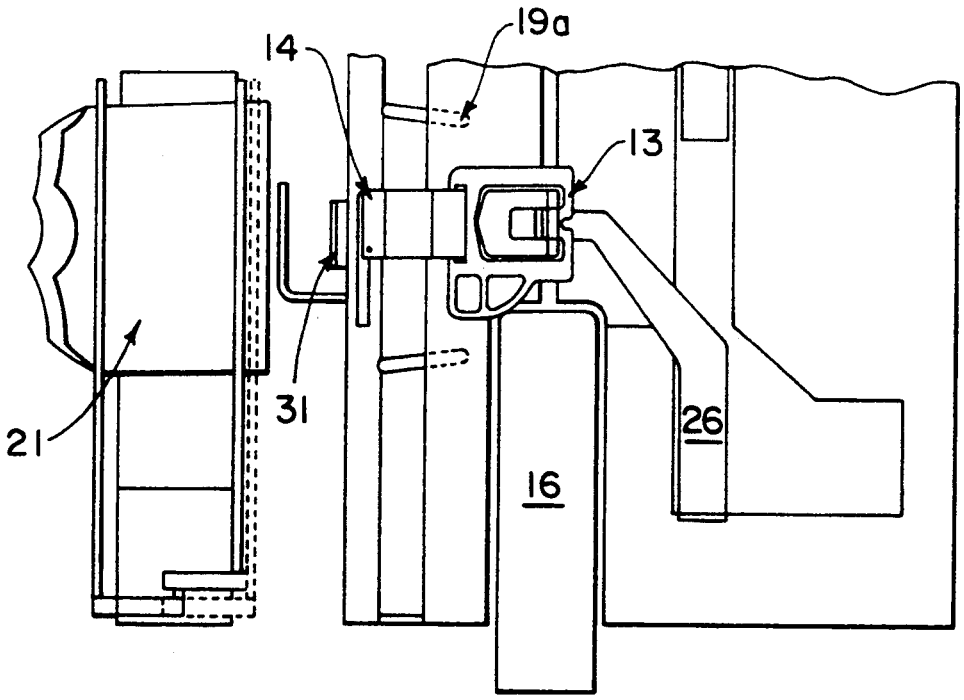
FIGS. 14 and 15 illustrate further movement of the stacker flip tube and clamp tube, and release of the puller to stack the garment body upon the material rest bar.
Figure 15:
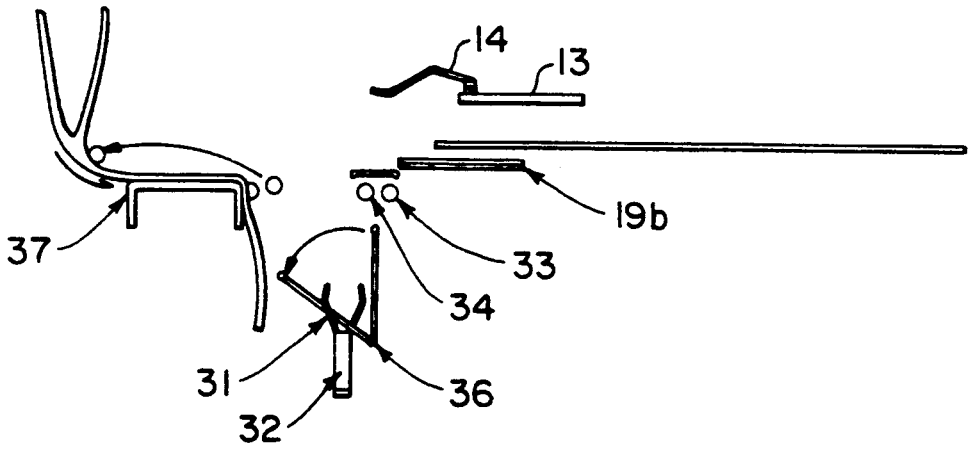
Figure 16:
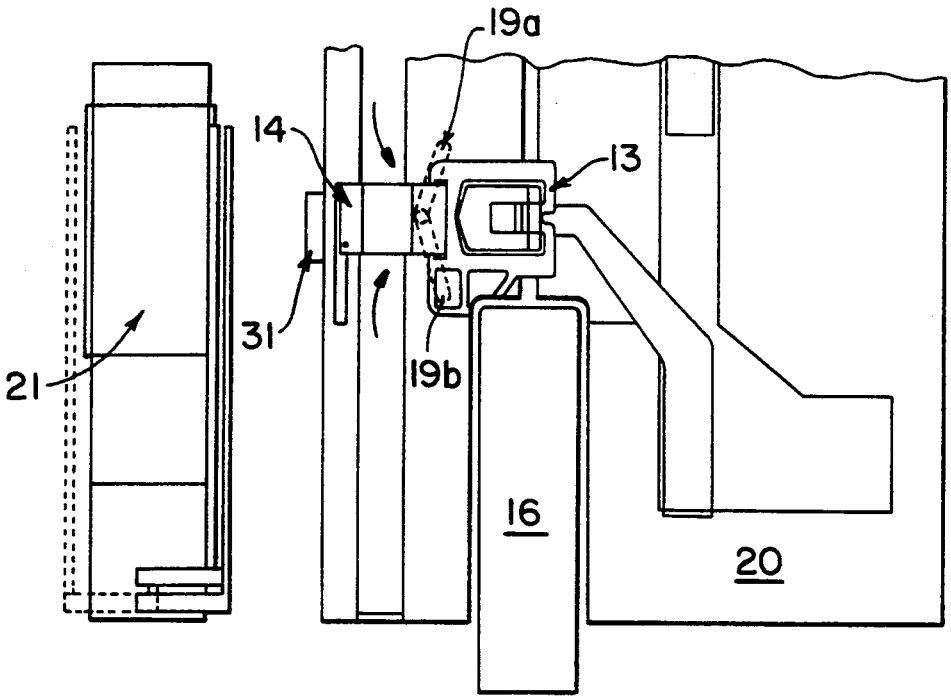
FIGS. 16 and 17 illustrate completion of stacking and return of the various mechanisms to their initial locations to begin the stacking sequence of a next successive garment body.
Figure 17:
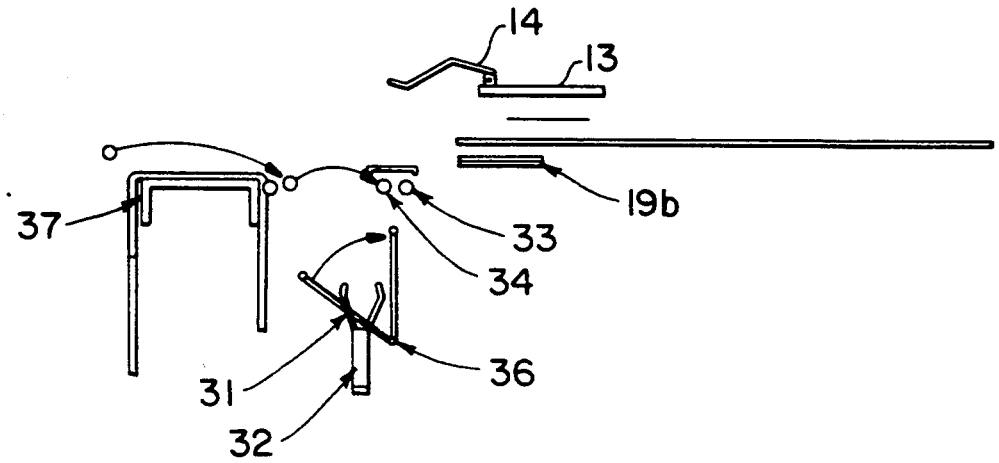

Accordingly, FIGS. 12 and 13 show the release of stitching clamp 13 thus freeing the shirt body for such movement toward the material rest bar 37. The stacker flip and clamp tubes 33, 34 move rapidly from their initial position of FIGS. 8–11 (in the direction of the arrow) to a position adjacent to the material rest bar 37 and in so doing flip the shirt body 21 over bar 37. Coordinated with such action is the release of tail section 21*h* from gripper 31 and movement of sweep bar 36. Final positioning of shirt body 21 over material rest bar 37 has been illustrated in FIGS. 16 and 17. The design of the equipment is such that approximately 48 pieces may be stacked upon the bar 37 before requiring removal of the stack.

It will be understood that the above-described apparatus is easily adaptable to pocket setting onto flat garment parts. In such use slide members and spreaders will remain inoperative. It shall be further understood that the above description has been of a particular embodiment, has been merely representative and modification thereof may be made without departing from the inventive concepts presented herein. In order therefore to understand fully the scope of the invention, reference should be made to the appended claims.

We claim:

1. The method of affixing a garment part to a tubular knit body comprising the steps of:

a) extending said body over an edge of a flat table to arrange an area of said tubular knit body to which the garment part is to be affixed upon an upper surface of said table without substantially distorting said area while simultaneously extending an opposite side of said body under said table;

b) depositing upon said area said garment part and pressing said garment part thereupon to clamp said part and said body against the upper surface of said table;

c) moving that portion of said tubular body which is under the table to clear the edge of said table and maintaining said portion clear of the edge of said table while maintaining the area of said body clamped against the upper surface of said table under said garment part in an undistorted condition;

d) sliding said garment body across said table with the garment part clamped thereupon to a position for stitching said part to said body while maintaining said area under said garment body in an undistorted condition;

e) stitching said part to said body; and f) releasing said garment body from said table.

2. The method according to claim 1 wherein prior to releasing said garment body from said table, that portion of said body initially moved from under the table is straightened, said garment body is then pulled from said table and stacked adjacent to said table.

3. An apparatus for affixing a garment part to a tubular knit body comprising:

a) a table defining a cut-out section therein comprising a loading station, said table section having two side edges over which said garment body can be longitudinally drawn without substantial stretching thereof to arrange that portion of said body to which said part is to be affixed upon an upper surface of said table section while an opposite side of said body is arranged beneath said table section;

b) means for depositing said garment part at said loading station upon said body;

c) means for clamping said part and said body against the upper surface of said table section said means for clamping enabling lateral sliding movement of said garment part and said body relative to said table without distortion thereof;

d) means for pushing the opposite side of said body longitudinally beneath said table section to be free of an edge of said table;

e) a sewing head arranged above said table laterally at a distance from said loading station which comprises a stitching station;

f) and means for sliding said garment body, garment part and clamping means toward and under said sewing head to affix said garment part to said garment body.

4. The apparatus of claim 3 wherein said garment part is a pocket and said clamping means includes a stitching clamp.

5. The apparatus of claim 4 which further includes a rail spaced from the edge of the table having an upper surface somewhat below a lower surface of said table, a tail portion of said garment body being adapted to lie smoothly and flatly over said rail after said garment body has been drawn onto said table section, and a traveling clamp connected to said stitching clamp having means to maintain the tail portion smoothly and flatly over said rail during lateral movement of said garment body from the loading station to the stitching station.

6. The apparatus of claim 5 which includes means for straightening the garment body beneath said table and clamp removal means to lift the stitch clamping means and the travel clamping means from said garment body after said garment part has been stitched to said body.

7. The apparatus of claim 6 wherein the means for straightening said garment body comprises a pair of spreader arms, means for inserting said arms into said body portion lying beneath said table and means for extending said arms thereafter to flatten and straighten said body portion lying beneath said table;

8. The apparatus of claim 7 which further includes means for pulling said garment body from beneath said clamping means and away from said table, and means for sequentially stacking successive ones of said garment body upon each other.

* * * * *